350-1.7 SR
XR 3,977,930

United Stat
Hunter

[11] 3,977,930
[45] Aug. 31, 1976

[54] OIL BASED ADHESION OF FILM TO WINDOW

[76] Inventor: John C. Hunter, 9150 Gallatin Road, Downey, Calif. 90240

[22] Filed: June 25, 1975

[21] Appl. No.: 590,053

[52] U.S. Cl. ..... 156/71; 156/99; 156/108; 350/1; 350/166; 427/165; 428/440; 428/458; 428/467

[51] Int. Cl.[2] ..... E04F 10/00

[58] Field of Search ..... 156/71, 99, 108; 350/1, 350/166; 427/165; 428/440, 467, 458

[56] References Cited

UNITED STATES PATENTS

| | | | |
|---|---|---|---|
| 3,334,009 | 8/1967 | Questel et al. | 428/440 |
| 3,514,175 | 5/1970 | Jenkins | 350/1 |
| 3,537,944 | 11/1970 | Grubb et al. | 350/1 |
| 3,775,226 | 11/1973 | Windorf | 428/458 |
| 3,776,805 | 12/1973 | Hansen | 428/458 |

*Primary Examiner*—Edward G. Whitby
*Attorney, Agent, or Firm*—William W. Haefliger

[57] ABSTRACT

Heat transmission through a solid window is reduced by:

a. providing a light transparent plastic sheet having a transparent metal layer on one surface of the sheet, the layer characterized as reflective to incident heat radiation, and applying the sheet to the window, and b. providing an oil film at the interface between the sheet and window to retain the sheet to the window, and c. smoothing the sheet to eliminate any bubbles that form at the interface.

8 Claims, 2 Drawing Figures

3977930
OR IN 156/71

OIL BASED ADHESION OF FILM TO WINDOW

BACKGROUND OF THE INVENTION

This invention relates generally to reduction of heat and glare transmission through windows; more particularly, it concerns the application to a window pane of a metallized, light transparent, heat reflective sheet and in such manner that the sheet may be removed as desired, or bodily shifted on the pane.

In the past, heat reflective sheets have been applied to windows as by bonding them in place. Bonding introduces problems and disadvantages which include difficulty of applying the bond; degradation of the metallized layer by chemical action of the bond composition; lack of capacity to easily remove or adjust the sheet once the bond has set; and the formation of bubbles at the bond which cannot be removed after the bond has set.

SUMMARY OF THE INVENTION

It is a major object of the invention to provide method and apparatus overcoming the above problems and disadvantages. Basically, the method contemplated by the invention involve the steps that include:

a. providing a light transparent plastic sheet having a transparent metal layer on one surface of the sheet, the layer characterized as reflective to incident heat radiation, and applying the sheet to the window, and b. providing an oil film at the interface between the sheet and window to retain the sheet to the window, and c. smoothing the sheet to eliminate any bubbles that form at the interface.

As will appear, the oil film typically consists of clear mineral oil and is applied at the interface between the metal layer and window surface; and the sheet typically consists of MYLAR, while the metal layer consists of aluminum.

The apparatus itself typically comprises:

a. a transparent plastic sheet having a light transparent metal layer on one surface of the sheet, the sheet applied to the window, the layer characterized as reflective to incident heat radiation, and b. an oil film at the interface between the sheet and window and removably retaining the sheet to the window.

These and other objects and advantages of the invention, as well as the details of an illustrative embodiment, will be more fully understood from the following description and drawings, in which:

DRAWING DESCRIPTION

FIG. 1 is a perspective showing of a window to which the heat and light reflecting means of the invention is attached; and FIG. 2 is a section through the window reflecting means of FIG. 1.

DETAILED DESCRIPTION

Figure 1:
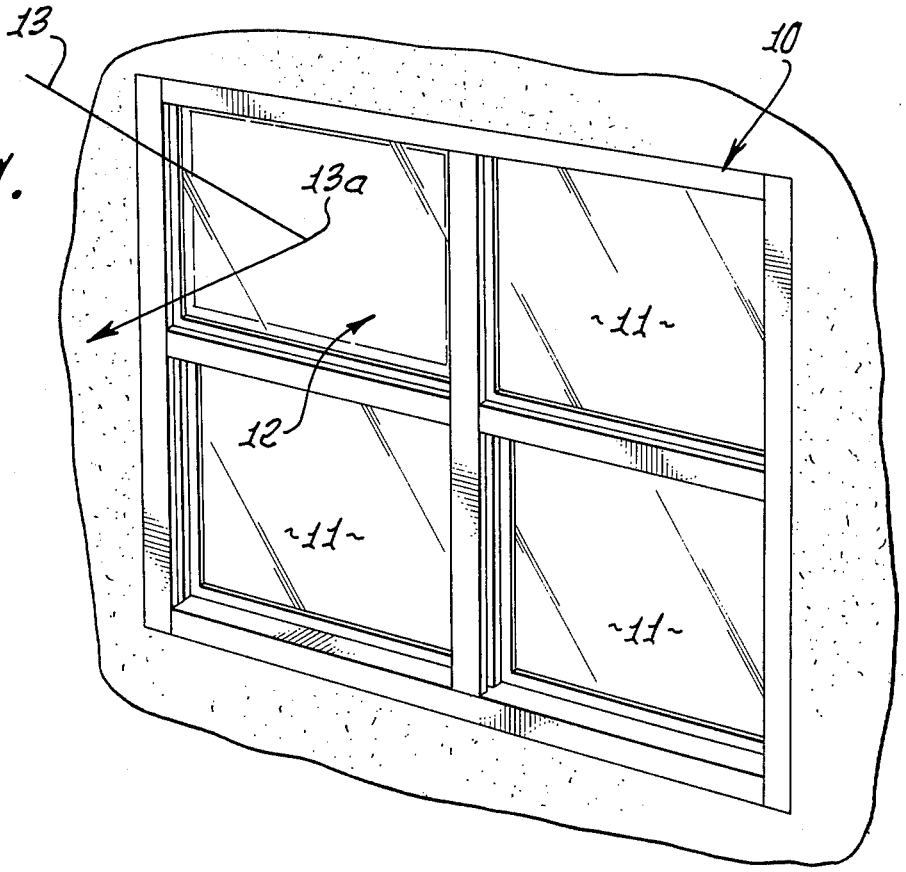

In FIG. 1, a window frame 10 contains glass or other solid transparent panes 11. To at least one of these is attached apparatus 12 for reducing heat transmission through the window. In this regard, ray 13, reflected at 13*a*, indicates heat or infrared radiation at least partly returned by the apparatus 12. Glare is also reduced in the same manner. As a result, fuel savings may be achieved through substantial reduction in loss of heat from rooms whose windows are provided with apparatus 12; also, transmission of external glare and infrared radiation through the window are reduced by apparatus 12.

Figure 2:
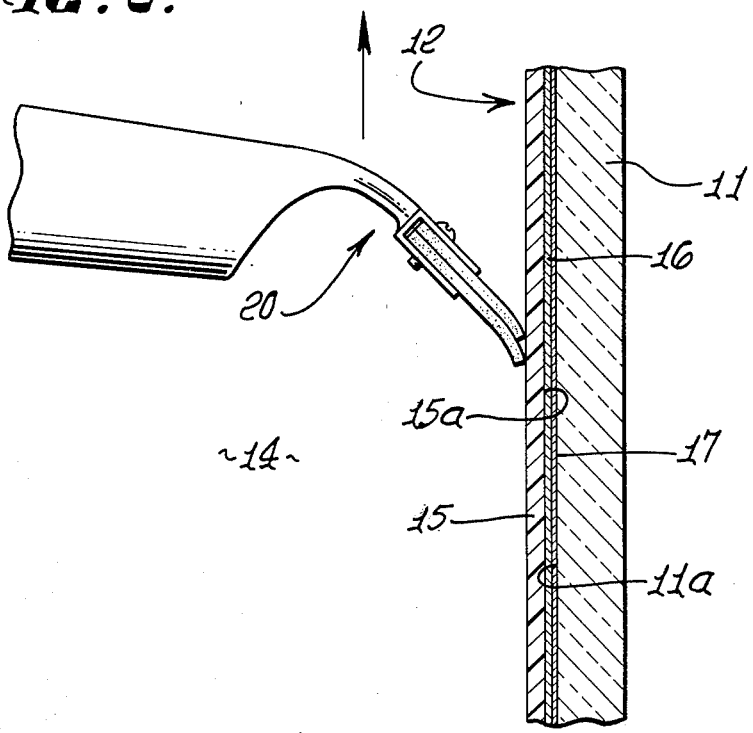

Referring to FIG. 2, the glass window pane 11 has a side 11*a* normally presented toward the interior 14 of a room. The apparatus 12 comprises a transparent plastic sheet 15 having a light transparent metal layer 16 on one surface 15*a* of the sheet. Layer 16 is characterized as reflective to incident heat radiation, and may consist of an extremely thin (a few millionths of an inch thick) layer of aluminum of uniform thickness. The plastic sheet may consist of MYLAR and may have a uniform thickness between 0.0005 and 0.003 inches, for best results. A usable metallized MYLAR is sold under the trademark SCOTCH TINT by the 3M Company.

The numeral 17 designates an oil film at the interface between the sheet and window for removably retaining the sheet to the window. For best results, film 17 consists of mineral oil, such as petrolatum, and has a viscosity between 55/60 and 340/360 centipoises. It is found that the oil film spreads to a substantially uniform thickness between the window and sheet so that visual distortion is minimized, and that it adequately retains the sheet to the window as by capillary attraction forces; and the same time, it permits removal of the apparatus 12 at any time, for application to other windows as desired. In addition, bodily adjustment of the apparatus 12 on and parallel to the window is facilitated.

The oil film may be provided at the interface between the sheet layer as by initial application to the window pane and spreading as by a squeegee. After application of the sheet and layer 15 and 16 to the oiled pane, the sheet is smoothed, as by squeegee 20, to eliminate any bubbles that form at the interface. If the sheet has been misaligned, it can be bodily shifted parallel to the pane, as the oil film does not set; also, the sheet can be removed as by forcible peeling away, for use on another window pane.

The oil film may also be thixotropic. Also, the oil film protects the uncoated surface of aluminum layer 16.

I claim:

1. The method of reducing heat transmission through a solid window, that includes, a. providing a light transparent plastic sheet having a transparent metal layer on one surface of the sheet, the layer characterized as reflective to incident heat radiation, and applying the sheet to the window, and b. providing a mineral oil film at the interface between the sheet metal layer and window to retain the sheet to the window, and c. smoothing the sheet to eliminate any bubbles that form at the interface.

2. The method of claim 1 wherein the metal layer consists of aluminum.

3. The method of claim 1 wherein the plastic sheet has a thickness between 0.0005 and 0.003 inches.

4. The method of claim 1 wherein the oil has a viscosity between 55/60 and 340/360 centipoise.

5. In combination with a solid window, apparatus for reducing heat transmission through the window, comprising a. a transparent plastic sheet having a light transparent metal layer on one surface of the sheet, the sheet applied to the window, the layer characterized as reflective to incident heat radiation, and b. a mineral oil film at the interface between the sheet metal layer and window and removably retaining the sheet to the window, said oil being in surface contact with the metal layer and window.

6. The combination of claim 5 wherein the metal layer consists of aluminum.

7. The combination of claim 5 wherein the plastic sheet has a thickness between 0.0005 and 0.003 inches.

8. The combination of claim 5 wherein the oil has a viscosity between 55/60 and 340/360 centipoise.

* * * * *